US008745836B2

(12) United States Patent
Murray

(10) Patent No.: US 8,745,836 B2
(45) Date of Patent: Jun. 10, 2014

(54) POUCH WITH A TUBE SPOUT FITMENT

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 375 days.

(21) Appl. No.: 12/881,908

(22) Filed: Sep. 14, 2010

(65) Prior Publication Data

US 2011/0061222 A1 Mar. 17, 2011

Related U.S. Application Data

(60) Provisional application No. 61/242,059, filed on Sep. 14, 2009.

(51) Int. Cl.
*B21D 39/00* (2006.01)

(52) U.S. Cl.
USPC ..... 29/428; 53/133.3; 206/489.1

(58) Field of Classification Search
USPC ..... 29/525.01, 525.13, 453, 773, 255; 222/92, 105; 53/488, 489, 133.1, 53/133.3; 383/10, 66, 80, 120, 906; 206/484, 484.1, 489.1
See application file for complete search history.

(56) References Cited

U.S. PATENT DOCUMENTS

| | | | | |
|---|---|---|---|---|
| 3,930,286 | A * | 1/1976 | McGowen | 222/83 |
| 4,445,550 | A * | 5/1984 | Davis et al. | 141/329 |
| 6,419,118 | B1 * | 7/2002 | Rees et al. | 222/94 |
| 7,032,363 | B1 * | 4/2006 | Annehed et al. | 53/412 |
| 7,600,360 | B2 * | 10/2009 | Schroeder et al. | 53/452 |
| 2006/0111224 | A1 * | 5/2006 | Caudle | 493/212 |

* cited by examiner

*Primary Examiner* — Lee D Wilson
*Assistant Examiner* — Steven A Maynard
(74) *Attorney, Agent, or Firm* — Gifford, Krass, Sprinkle, Anderson & Citkowski, P.C.

(57) ABSTRACT

A process for placing a tube spout fitment within a flexible pouch container is provided. The process can include providing a front panel and a back panel, each panel having a top edge, a side edge, and a bottom edge. In addition, the front panel can also have an aperture. A fitment having a fitment base and a spout extending from the fitment base is provided and placed through the aperture using a plate with a channel and a channel stop.

19 Claims, 3 Drawing Sheets

POUCH WITH A TUBE SPOUT FITMENT

CROSS-REFERENCE TO RELATED APPLICATIONS

This application claims priority of U.S. Provisional Patent Application Ser. No. 61/242,059 filed Sep. 14, 2009, which is incorporated herein by reference.

FIELD OF THE INVENTION

The present invention relates generally to a flexible pouch with a tube spout fitment, and in particular, to a process for making the flexible pouch with the tube spout fitment.

BACKGROUND OF THE INVENTION

Flexible pouches with and without a tube spout fitment and a dispensing cap are known. Most pouches with tube spout fitments commonly include the fitment within a seam along a side edge of the pouch. Location of the fitment within the seam can facilitate the manufacturing process since the tube spout fitment can be positioned along a side edge of a sheet and the sheet folded onto the fitment and sealed thereto. However, such pouches must be physically manipulated so as to drain the contents of the pouch through the spout fitment. As such, it would be desirable to have a pouch with the tube spout fitment located along or within the body of the pouch so as to dispense contents of the pouch using gravity.

Installing the tube spout fitment along the body of the pouch requires precision. In particular, the tube spout fitment must be precisely placed within an aperture formed in a pouch panel with failure resulting in an improper seal between the panel and the fitment. As such, it would be desirable to have a process for installing the tube spout fitment that is cost effective and yet precise with respect to placing the fitment within the aperture.

In addition to the above, distribution of flexible pouches with a tube spout fitment is often performed by packaging a plurality of pouches into a shipping container and transporting the container to a location where the pouches are filled with a product. However, once the dispensing cap is placed on or attached to the tube spout fitment, the cap can be difficult to remove from the fitment in order to allow filling of the pouch. As such, tube spout fitment-type pouches are often package and transported without, or before, the dispensing cap is attached to the fitment. Although packaging and transportation in this manner solves the problem of removing the dispensing cap from the tube spout fitment, the absence of the cap can allow dust, dirt, etc., to enter the interior of the pouch through the fitment. Therefore, a process and/or tube spout fitment-dispensing cap combination that prevents such contamination of the interior of the pouch during shipping would be desirable.

SUMMARY OF THE INVENTION

A process for placing a tube spout fitment within a flexible pouch container is provided. The process can include providing a front panel with an aperture and a back panel, each panel having a top edge, a side edge, and a bottom edge. The process includes sealing the side edges together to form a side seam and providing a plate that has a channel and a channel stop. A fitment having a fitment base and a spout extending from the fitment base is provided and the fitment base is dimensioned to fit at least partially within the channel of the plate and yet not be able to pass through the aperture of the front panel.

The base of the fitment is placed at least partially within the channel of the plate such that it abuts against the channel stop, the channel stop affording positioning of the fitment at a desired location on the plate. In addition, the bottom edges of the front and back panels are opened and/or spaced apart from each other and the plate with the fitment is slid between the bottom edges of the front and back panels until the spout is aligned with the aperture of the front panel. The front panel is then placed over the spout, e.g. by lowering, pushing, and/or vacuum, such that the spout extends through the aperture. The plate can then be removed from between the front and back panels leaving the spout within or extending through the aperture and the fitment base located between the front and back panels. It is appreciated that the plate is dimensioned to slide between the front and back panels such that the channel holds the fitment at a location such that it aligns with the aperture in the front panel.

In some instances, the front panel and the back panel each have a pair of side edges, the pair of side edges sealed together to form a pair of side seams. The plate can be dimensioned to slide between the pair of side seams. In addition, the top edges of the front and back panels can be sealed together before, during or after sliding of the plate with the fitment between the bottom edges of the panels. The top seam may or may not have one or more finger apertures for grasping the flexible pouch container. The finger aperture(s) have a perimeter edge and the edge that may or may not have a scalloped outline/shape.

The aperture of the front panel has a perimeter that can be sealed to the fitment base to form a fitment base seam. In addition the bottom edges of the front panel and the back panel can be sealed together to form a bottom seam, and thus provide a flexible pouch container having a tube spout fitment sealed thereto. It is appreciated that such a flexible pouch container can be filled with a product through the fitment.

A push-pull dispensing cap can further be provided and be dimensioned to snap onto the spout and be attached thereto. The spout extending through the aperture of the front panel can have a first circumferential ridge proximate a spout end and a second circumferential ridge proximate the fitment base. The dispensing cap can have a first snap position fitting over the first circumferential ridge and a second snap position fitting over the second circumferential ridge. In addition, the first snap position can form a temporary attachment of the dispensing cap onto the spout and the second snap position can form a permanent attachment of the cap onto the spout.

In some instances, an automated gripper can place the fitment base at least partially within the channel of the plate such that the base abuts the channel stop. In addition, the same or a different automated gripper can slide the plate and the fitment between the bottom edges of the front and back panels until the spout is aligned with the aperture of the front panel. The automated gripper can then remove the plate from between the front and back panels after the front panel has been placed over the spout, the spout extending through the aperture, thereby leaving the fitment base between the front and back panels and the spout extending outwardly through the front panel.

A gusset having at least a pair of edges can be included between the front and back panels. The gusset edges can be sealed to the top, side and/or bottom edges of the front and back panels. The bottom edge of the front panel and a respective or appropriate gusset edge can remain unsealed until after the spout of the fitment has been placed within the aperture and the plate removed from between the front and back panels.

The push-pull dispensing cap can be temporarily attached to the spout of the fitment by forcing the cap over the first circumferential ridge. In this manner, the dispensing cap can prevent dust, dirt, etc. from entering the interior of the flexible pouch during shipping, storage, etc. Upon arrival at a filling location, the dispensing cap can be removed from its temporary position/attachment and the flexible pouch filled with a product through the tube spout fitment. Thereafter, the dispensing cap can be permanently attached to the tube spout fitment by pushing and/or locating the cap over the first and second circumferential ridges of the spout. It is appreciated that the permanent attachment of the push-pull cap on the spout can afford for a gas- and/or liquid-tight seal for the flexible pouch.

DETAILED DESCRIPTION OF THE INVENTION

The present invention discloses a process for placing a tube spout fitment within a flexible pouch container. As such, the present invention has utility as a process for making a flexible pouch.

The process includes providing a flexible pouch container that has a pair of oppositely disposed bottom edges that can be opened or spaced apart from each other. In addition, a plate that has a groove or channel that a tube spout fitment can be seated at least partially within is included. The plate with the channel can have a channel stop that the tube spout fitment can abut up against. The plate with the tube spout fitment can slide between the opened bottom edges of the front and back panels such that the tube spout fitment is located directly under or in alignment with an aperture in the front panel. Thereafter, the front panel can be placed over a spout portion of the fitment and the plate can be removed between the front and back panels with the fitment remaining behind, i.e. the spout portion extending through the aperture and a fitment base remaining between the front and back panels.

The fitment base can fit at least partially within the channel of the plate and yet not fit through the aperture of the front panel. In addition, the aperture has a perimeter and/or perimeter region that can be sealed to the fitment base.

In some instances, a robotic arm and/or automated gripper can grasp the plate and place and/or align the fitment relative to the aperture of the front panel. In this manner, placement of the tube spout fitment between front and back panels of the flexible pouch container can incorporate as part of an automated flexible pouch manufacturing machine and/or process.

A gusset can be placed at least partially between the front panel and the second panel such that a generally flat bottomed container with a tube spout fitment located proximate to a bottom region of the container is provided. The flexible pouch container can have one or more finger apertures that afford for an individual to grasp the container, the finger apertures having a generally circular shape, elongated shape, and the like. In addition, the finger apertures may or may not have a scalloped outline or shape that can aid in grasping the pouch, carrying of the pouch, and the like.

Figure 1:
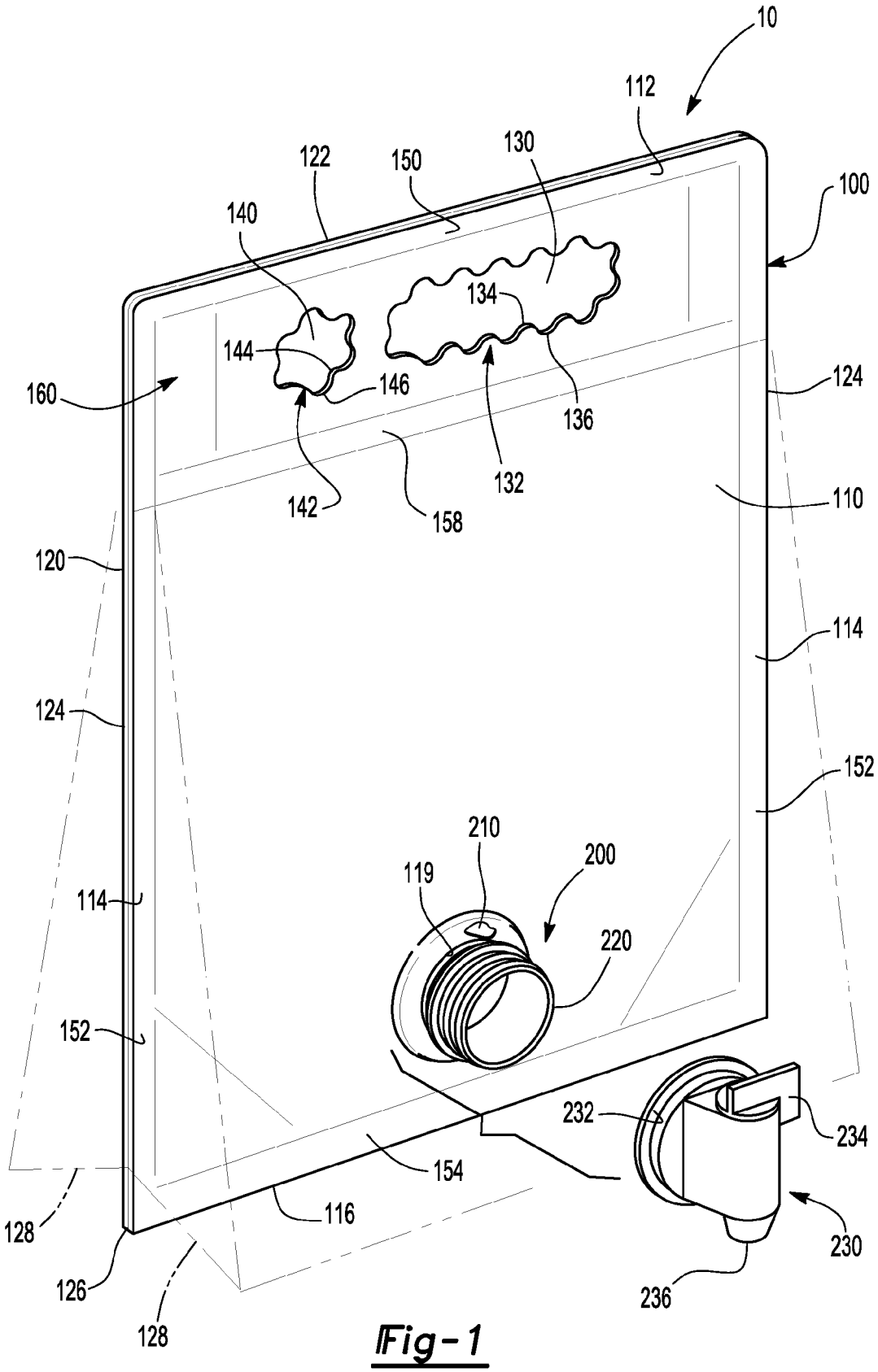
FIG. 1 is a perspective view of a flexible pouch container with a tube spout fitment according to an embodiment of the present invention.

Turning now to the figures, FIG. 1 illustrates a perspective view of a flexible pouch container 10 according to an embodiment of the present invention. The container 10 can have a pouch body 100 that includes a front panel 110 and a back panel 120. The front panel 110 can have a top edge 112, a side edge 114, and a bottom edge 116. Similarly, the back panel 120 can have a top edge 122, a side edge 124, and a bottom edge 126. The edges of the front panel and the back panel can be sealed together using any device, system, process, etc., known to those skilled in the art to form a top seam 150, a side seam 152 and a bottom seam 154. In some instances, a gusset 128 can be included between the front panel 110 and the bottom panel 120 as known to those skilled in the art. The gusset 128 affords for greater volume to be located between the front panel 110 and the back panel 120. It is appreciated that the gusset 128 can be sealed to the top edges, side edges, and/or bottom edges of the front panel 110 and/or bottom panel 120.

Figure 2:
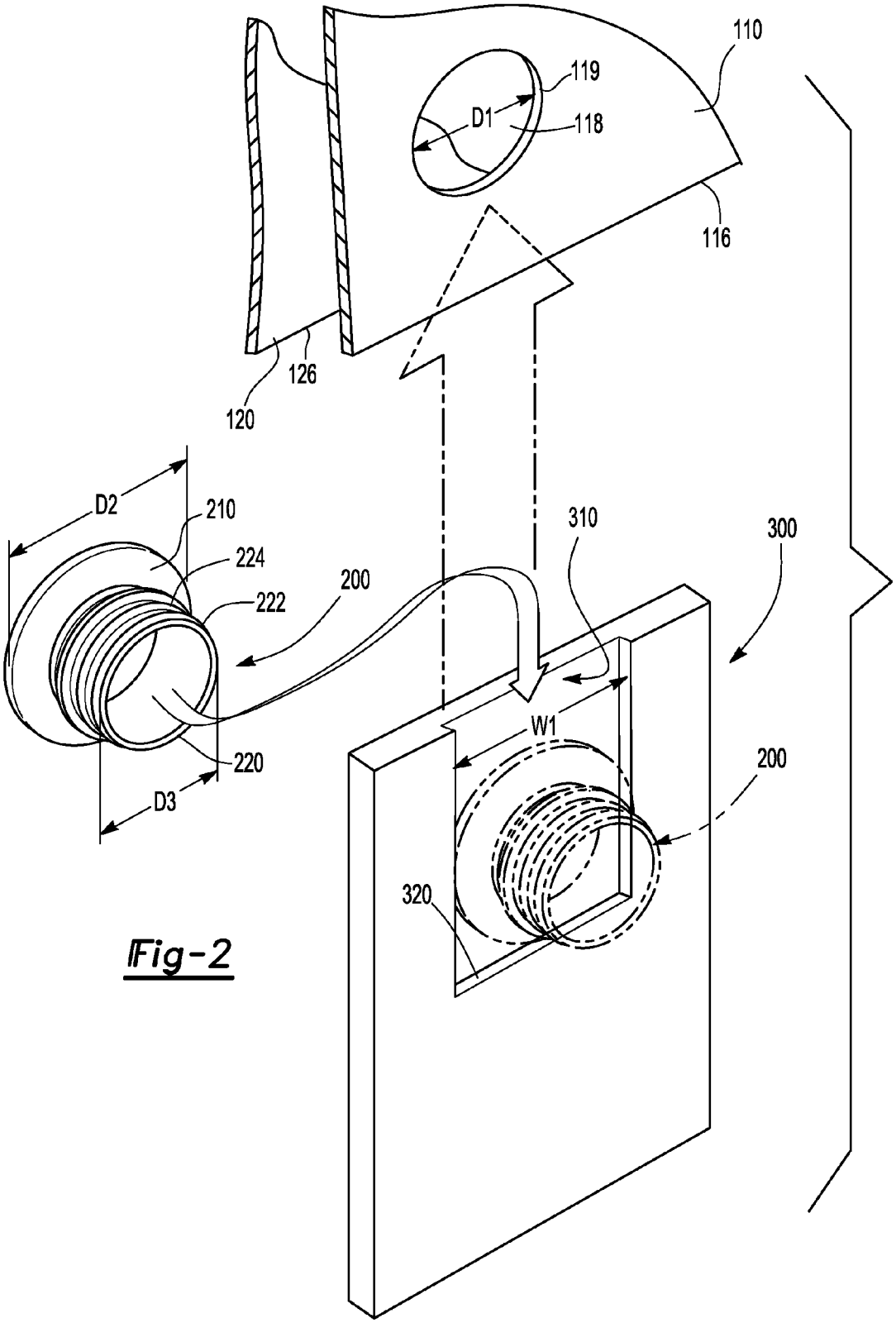
FIG. 2 is a perspective view of a plate used to place the tube spout fitment at a precise location relative to the flexible pouch shown in FIG. 1.

Referring to FIG. 2, the front panel 110 can have an aperture 118, the aperture 118 having a perimeter 119. In addition, a tube spout fitment 200 having a base 210 and a spout 220 can be provided and sealed to the front panel 110, thereby providing an opening for filling and/or dispensing of product from the pouch 10. As illustrated in FIG. 2, a plate 300 having a channel 310 and a channel stop 320 extending across a width W1 of the channel 310 affords for the tube spout fitment 200 and/or the base 210 to be located at least partially within the channel 310. The plate 300 with the fitment 200 can be slid between the front panel 110 and the back panel 120 until the fitment 200 located in a desired position relative to the aperture 118. In the alternative, the back panel 120 can be replaced with a portion of the gusset 128 and the plate 300 with the fitment 200 can be slid between the front panel 110 and the portion of the gusset 128 until the fitment 200 located in a desired position relative to the aperture 118.

The aperture 118 can have a diameter D1 and the base 210 of the fitment 200 can have a diameter D2 that is greater than D1 while the spout 220 has a diameter D3 that is less than D1. In this manner, the spout portion 220 can fit through the aperture 118 while the base 210 cannot. The diameter D2 of base 210 can also be slightly less than the width W1 of the channel 310. In some instances, there can be an interference fit between the channel 310 and the base 210 such that the tube spout fitment 200 is held in place while the plate 300 is moved into position. In the alternative, the plate 300 can be located in a generally horizontal orientation, as can be front panel 110 and back panel 120, such that an interference fit between the tube spout fitment 200 and the channel 310 is not required. Upon placement of the front panel 110 over or onto the spout 220, the spout 220 extends through the aperture 118 with the base 210 remaining between the panels 110, 120. Thereafter, the plate 300 can be withdrawn from between the front and back panels 110, 120 while the fitment is left behind in a desired location to be sealed to the pouch 10.

Figure 3:
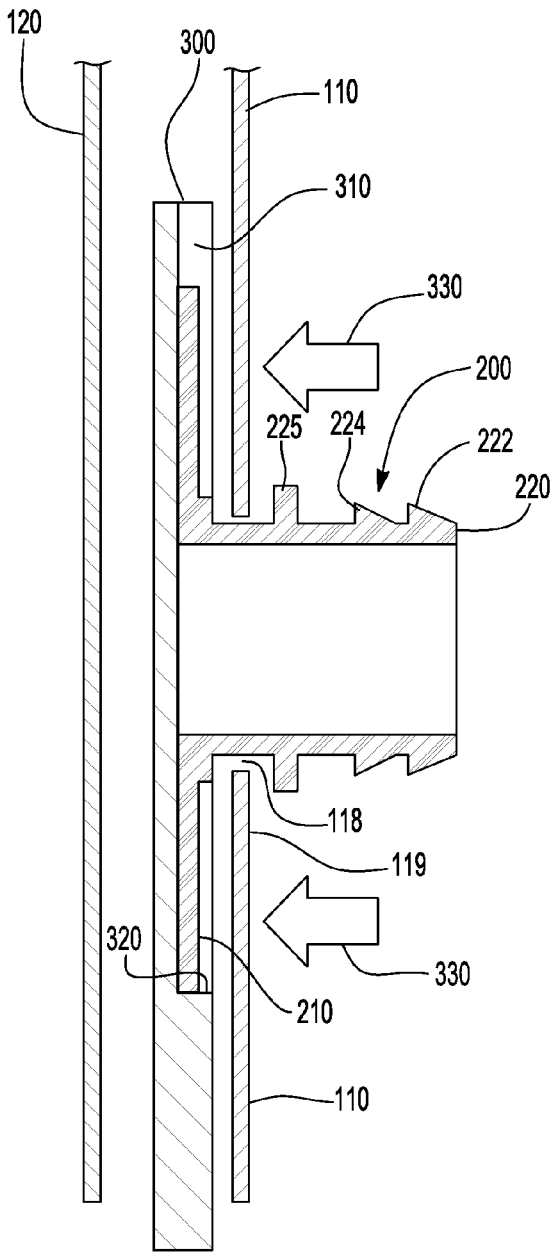
FIG. 3 is a side cross-sectional view of the tube spout fitment and the flexible pouch shown in FIG. 2.

Referring to FIG. 3, a cross-sectional view of the tube spout fitment 200 extending through the aperture 118 of the front panel 110 with the base 210 between the panels 110, 120 is shown. In some instances, the front panel 110 can be pushed over a flange 225 extending from the spout portion 220 as illustrated by the arrows 330. It is appreciated that the diameter of the flange 225 can be larger than the diameter D1 of the aperture 118, but since the panel 110 is made from a flexible and/or pliable material, the panel 110 can be pressed over the flange 225. In this manner, the tube spout fitment 220 can be held in place before the base 210 is actually sealed to the panel.

The perimeter 119 and/or a perimeter region adjacent to the aperture 118 can be sealed to the base 210 before or after the plate 300 has been removed from between the panels 110 and 120. As such, the plate 300 can be made from a material durable enough to withstand heat or ultrasonic welding such that it is not sealed to the inner surface of the front panel 110 during sealing of the panel to the base 210. An example of such a material adaptable for such a use includes Teflon®. In the vent that the perimeter 119 and/or or a perimeter region adjacent to the aperture 118 is sealed to the base 210 before the plate 300 is removed from between the panels 110 and 120, it is appreciated that the base 210 can have a thickness that is equal to or greater than a depth of the channel 310.

The front panel 110 can be sealed to the base 210 using one or more steps. For example and for illustrative purposes only, a first step can include applying a low melt tack seal as known to those skilled in the art. The low melt tack seal can melt the inner surface of the front panel 110 by subjecting the outer surface of the panel to temperature and pressure such that the tack seal becomes gelatinous. In this manner, the low melt tack seal can spread uniformly along or between the inner surface of the panel 110 and the base 210. Thereafter, a high pressure/high temperature seal can be applied which may or may not be cooled thereafter.

In addition to the tube spout fitment 200, the pouch 10 can have one or more apertures 130, 140 located along a top portion 160. For example and for illustrative purposes only, a generally elongated finger aperture 130 and/or a generally circular finger aperture 140 can be provided. It is appreciated that other shaped apertures can be provided within the scope of the invention. The apertures 130, 140 have a perimeter 132, 142 as shown in the figure and the perimeter may or may not be scalloped-shaped with a plurality of alternating ridges 134, 144 and valleys 136, 146. The scalloped shaped perimeter 132, 142 increases the length and/or surface area of the perimeter edge that will be in contact with an individual's finger or fingers grasping the pouch 10 and thus can reduce pressure on the finger or fingers applied by the flexible pouch container 10 filled with a product.

A push-pull dispensing cap 230 can be provided and attached to the fitment 200. It is appreciated that the push-pull dispensing cap 230 can provide for opening and closing of the container 10 using any device and/or method known to those skilled in the art. For example, the cap 230 can have a turn tab 234 that affords for a product to flow from the pouch 10 through an end 236. In this manner product can be conveniently dispensed from the pouch 10.

The push-pull dispensing cap 230 can have an attachment portion 232 that can fit over the spout 220 of the fitment 200. The spout 220 can have a first circumferential ridge 222 and a second circumferential ridge 224. The attachment portion 232 can fit over the first circumferential ridge 222 in order to provide a temporary attachment of the cap 230 to the fitment 200. In some instances, the temporary attachment affords for the cap 230 to be removed from the fitment 200 with a minimum amount of force, for example 4 pounds of pulling force. In this manner, the cap 230 can be placed over the fitment 200 and prevent contamination from occurring within the pouch container 10 during storage, shipment, manufacture, and the like, and then removed for filling of the pouch 10 with a product through the fitment 200.

The flexible pouch 10 can be filled through the tube spout fitment 200 before the cap 230 has been attached thereto or in the alternative after the cap 230 has been removed therefrom. Once the pouch 10 has been filled, the cap 230 can be permanently attached to the tube spout fitment 200 by pushing the spout portion 232 over the first circumferential ridge 222 and the second circumferential ridge 224. It is appreciated that the permanent attachment of the cap 230 onto the tube spout fitment 200 affords for a gas- and/or liquid-tight seal such that the product does not spill or leak from the pouch 10. Stated differently, the cap 230 is permanently attached to the tube spout fitment 200 such that product flows from the pouch 10 only through the use of the cap 230 as known to those skilled in the art.

Figure 4:
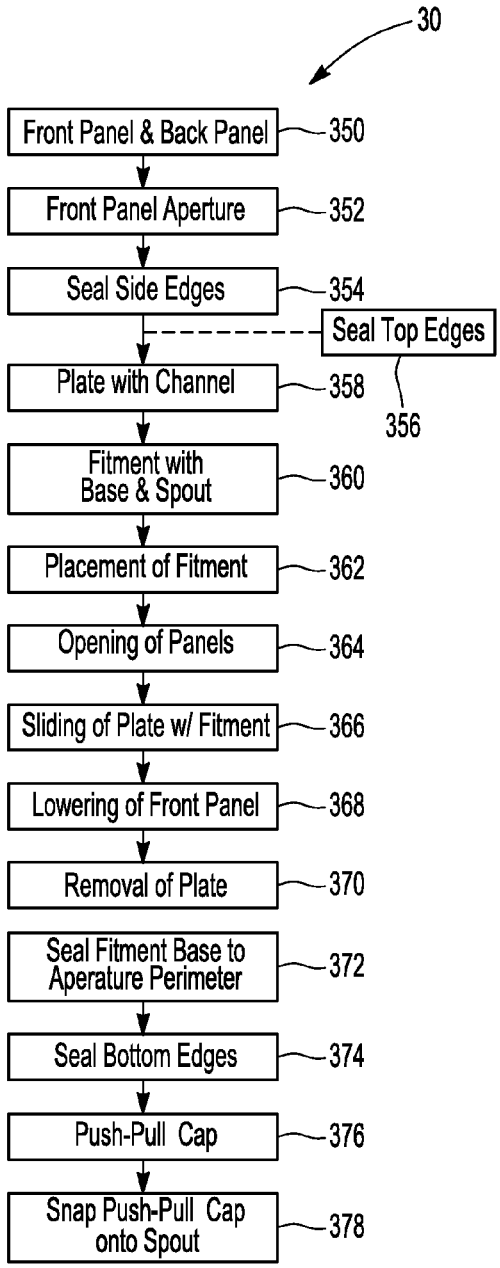
FIG. 4 is a schematic diagram illustrating a process for placing a tube spout fitment within a flexible pouch container according to an embodiment of the present invention.

Turning now to FIG. 4, a process for placing the tube spout fitment within a flexible pouch container is shown generally at reference numeral 30. The process 30 includes providing a front panel and a back panel at step 300 and forming an aperture within the front panel at step 302. As stated above, the front panel and the back panel each have a top edge, a side edge, and a bottom edge, and the side edges of the front and back panels are sealed at step 304. Optionally, the top edges of the front and back panels can be sealed at step 306.

At step 308 a plate with a channel and a channel stop is provided while a fitment with a base and a spout portion is provided at step 310. Thereafter, the fitment and/or fitment base is placed at least partially within the channel of the plate at step 312 such that the fitment base abuts against the channel stop and the front and back panels are opened and/or spaced apart from each other at step 314. The plate with the fitment is slid between the two panels at step 316 and the front panel is placed over the spout of the fitment such that the spout extends through the aperture at step 318.

The plate is removed at step 320 and the fitment base is sealed to the aperture perimeter of the front panel at step 322. In the alternative, the front panel can be sealed to the base of the fitment before the plate is removed. The bottom edges of both panels or the bottom edge of the front panel and a corresponding edge of a gusset are sealed at step 324. The push-pull dispensing cap can be provided at step 326 and snapped onto the spout of the fitment at step 328.

It is appreciated that the various steps shown in FIG. 4 can occur at different locations or using a different sequence than as shown in the figure and/or all the steps are not required. In addition, the front panel, the back panel, an optional gusset, the tube spout fitment, and push-pull dispensing cap can be made from any material known to those skilled in the art, illustratively including polymers used to handle food products, alcohol products, medical products, industrial products, and the like.

The invention is not restricted to the illustrative examples described above. The examples are not intended as limitations on the scope of the invention. The processes, apparatus, compositions, and the like described herein are exemplary and not intended as limitations on the scope of the invention. Changes herein and other uses will occur to those skilled in the art. The scope of the invention is defined by the scope of the claims.

I claim:

1. A process for placing a tube spout fitment within a flexible pouch container, the process comprising:

providing a front panel and back panel, each panel having a top edge, a side edge and a bottom edge, the front panel also having an aperture;

sealing the side edges together to form a side seam;

providing a plate having a channel and a channel stop extending across a width of the channel, the channel and channel stop being integral with the plate;

providing a fitment having a fitment base and a spout extending from the fitment base, the fitment base dimensioned to fit at least partially within the channel and not pass through the aperture;

placing the fitment base at least partially within the channel abutting against the channel stop;

opening the bottom edges of the front and back panels;

sliding the plate and the fitment between the bottom edges of the front and back panels until the spout is aligned with the aperture of the front panel;

placing the front panel over the spout, the spout extending through the aperture; and removing the plate from between the front and back panels leaving the spout within the aperture, the fitment base located between the front and pack panels.

2. The process of claim 1, wherein the front panel and the back panel each have a pair of side edges.

3. The process of claim 2, further including sealing the pair of side edges together to form a pair of side seams.

4. The process of claim 3, wherein the plate is dimensioned to slide between the pair of side seams.

5. The process of claim 1, further including sealing the top edges together to form a top seam.

6. The process of claim 5, wherein the top seam has a finger aperture.

7. The process of claim 6, wherein the finger aperture has a perimeter edge, at least part of the perimeter edge having a scalloped outline.

8. The process of claim 1, further including sealing a perimeter of the aperture to the fitment base to form a fitment base seam.

9. The process of claim 1, further including sealing the bottom edges together to form a bottom seam.

10. The process of claim 1, further including providing a dispensing cap for the spout, the dispensing cap dimensioned to snap onto the spout and be attached thereto.

11. The process of claim 10, wherein the spout has a first circumferential ridge proximate a spout end and a second circumferential ridge proximate the fitment base, the dispensing cap having a first snap position fitting over the first circumferential ridge and a second snap position fitting over the second circumferential ridge.

12. The process of claim 11, wherein the first snap position forms a temporary attachment of the dispensing cap onto the spout and the second snap position forms a permanent attachment of the dispensing cap onto the spout.

13. The process of claim 1, further including providing an automated gripper placing the fitment base at least partially within the channel abutting against the channel stop.

14. The process of claim 1, further including providing an automated gripper sliding the plate and the fitment between the bottom edges of the front and back panels until the spout is aligned with the aperture of the front panel.

15. The process of claim 14, wherein the automated gripper removes the plate from between the front and back panels leaving the spout within the aperture, the fitment base located between the front and pack panels.

16. The process of claim 1, further including a gusset having a pair of edges, one of the edges sealed to the bottom edge of the back panel.

17. The process of claim 16, further including sealing the other edge of the gusset to the bottom edge of the front panel after the plate has been removed from between the front and back panels.

18. A process for placing a tube spout fitment within a flexible pouch container, the process comprising:

providing a front panel and back panel, each panel having a top edge, a side edge and a bottom edge;

forming an aperture in the front panel;

sealing the side edges together to form a side seam;

providing a plate having a channel and a channel stop extending across a width of the channel, the channel and channel stop being integral with the plate;

providing a fitment having a fitment base and a spout extending from the fitment base, the fitment base dimensioned to fit at least partially within the channel and not pass through the aperture;

placing the fitment base at least partially within the channel abutting against the channel stop;

opening the bottom edges of the front and back panels, the bottom edge of the front panel spaced apart from the bottom edge of the back panel a predefined distance greater than a length of the fitment;

sliding the plate and the fitment in an upward direction between the bottom edges of the front and back panels until the spout is aligned with the aperture of the front panel;

lowering the front panel over the spout, the spout extending through the aperture;

removing the plate from between the front and back panels leaving the spout within the aperture, the fitment base located between the front and pack panels.

19. The process of claim 1, wherein the plate and the fitment slide in an upward direction between the bottom edges of the front and back panels until the spout is aligned with the aperture of the front panel.

* * * * *